United States Patent [19]

Thorne

[11] 4,019,616

[45] Apr. 26, 1977

[54] LINEAR MOTION DRIVE APPARATUS FOR A PRINTER CARRIAGE

[75] Inventor: William Duncan Thorne, Raleigh, N.C.

[73] Assignee: International Business Machines Corporation, Armonk, N.Y.

[22] Filed: June 24, 1976

[21] Appl. No.: 699,286

[52] U.S. Cl. ..... 197/90; 74/89.15; 74/424.8 R; 74/459

[51] Int. Cl.[2] ..... B41J 19/00

[58] Field of Search ..... 197/90, 89, 82, 84 R, 197/84 A, 84 B; 74/424.8 R, 459, 89.15

[56] References Cited

UNITED STATES PATENTS

| | | | |
|---|---|---|---|
| 2,439,470 | 4/1948 | Jackson | 197/84 B X |
| 2,446,393 | 8/1948 | Russell | 74/459 X |
| 3,147,631 | 9/1964 | Larsh | 74/424.8 R |
| 3,161,074 | 12/1964 | Korthaus et al. | 74/424.8 R |
| 3,468,401 | 9/1969 | Letz | 74/424.8 X |
| 3,509,981 | 5/1970 | Hylan et al. | 197/82 |
| 3,777,587 | 12/1973 | Hoshina et al. | 74/424.8 R |

*Primary Examiner*—Clifford D. Crowder
*Attorney, Agent, or Firm*—Edward H. Duffield

[57] ABSTRACT

For typewriters, disk printers or similar moveable print element devices, a carrier is provided to move the print element. The carrier acts by cooperation between a lead screw, mounted in stationary supports in a nonrotating fixture, and rotatable nut members supported in the print element carrier and threadedly engaging the lead screw. A motor is provided for rotating the nuts and the motor is arranged so that the rotor of the motor, the nuts and the lead screw are arranged in concentric fashion so that the motor, nuts and carrier assembly ride back and forth on the fixed lead screw, depending upon the direction of rotation of the motor.

1 Claim, 2 Drawing Figures

LINEAR MOTION DRIVE APPARATUS FOR A PRINTER CARRIAGE

FIELD OF THE INVENTION

This invention relates to printing machines, typewriters and other similar business machines in which a printing element must be moved back and forth in linear fashion in front of a sheet of paper or similar media to be marked upon. The print element is mounted on a carrier and the invention relates particularly to the print element carrier driver apparatus.

PRIOR ART

A wide variety of linear motion actuator devices for printing machines of the class described have been previously devised and/or patented. For example, U.S. Pat. 3,835,976 discloses a print element carrier device in which rotatable nuts in the carrier engage a fixed lead screw. Means are provided for rotating the nuts which means includes a rotatable line shaft with slidable pinion gears on it which gears engage rotatable gears and nuts on the carrier device. While effective for the purpose of moving the print carrier back and forth along a print line, this device is mechanically more complex and expensive than is desired and involves a good deal more inertia, mechanical wear, adjustment, etc. and is more difficult to assemble and maintain than would be preferred.

Other types of devices, such as illustrated in U.S. Pat. Nos. 2,909,935 and 3,908,809, for example, utilize a carriage which is drawn back and forth along the print line by means of a cable attached to rotatable pulleys for movement in either direction. These devices are also effective, but are mechanically more complex and expensive than is to be ideally desired.

Still another type of prior art device is exemplified in the so-called moving lead screw type of device in which a lead screw having one or more helically grooved paths on it is rotated by a motor or other suitable drive means to engage a nut mounted in a carrier member for translating the rotary motion of the lead screw into linear motion. For example, U.S. Pat. Nos. 3,800,933, 3,757,922, and 3,356,199 illustrate such mechanisms. None of these devices are as mechanically stiff or self damping as would be desired for accurate printing on a long term basis.

OBJECTS OF INVENTION

In light of the aforementioned difficulties with complexity, expense, mass, inertia and wear problems inherent in the mechanical designs heretofore utilized for this class of device, it is an object of the present invention to provide an improved print carrier drive apparatus for translating a print carrier back and forth along a line of print in a printing or business machine in which a printer or other suitable mechanism is mounted on the carrier for motion therewith.

A further object of the present invention is to reduce the mechanical complexity and difficulty of manufacture and assembly by providing an improved design in which the close mechanical tolerances and a number of mechanical parts are reduced.

Still another object of the present invention is to provide an improved print carrier apparatus which is more compact in design and which has greater rigidity and a lower moment of inertia than previously utilized devices.

Another object is to provide improved positioning with a minimum amount of error and minimum transient oscillation, thereby increasing throughput by reducing delay times.

SUMMARY

The foregoing objects are obtained in the present invention by providing a concentric assembly comprising a driving motor, a threaded lead screw, and one or more driven nuts engaging the screw, together with a carrier affixed to the motor, and rotatable nut assembly apparatus so that, when the motor is energized to rotate in a given direction, the nuts will be rotated and engage the threads on a lead screw which is held in a fixed position by the frame of the device. The result is a linear motion of the carrier and motor assembly along the screw, according to the direction of rotation of the motor.

BRIEF DESCRIPTION OF THE DRAWINGS

The aforementioned objects of the invention are met in a preferred embodiment thereof as detailed in the specification which follows in which.

DETAILED SPECIFICATION

Figure 1:
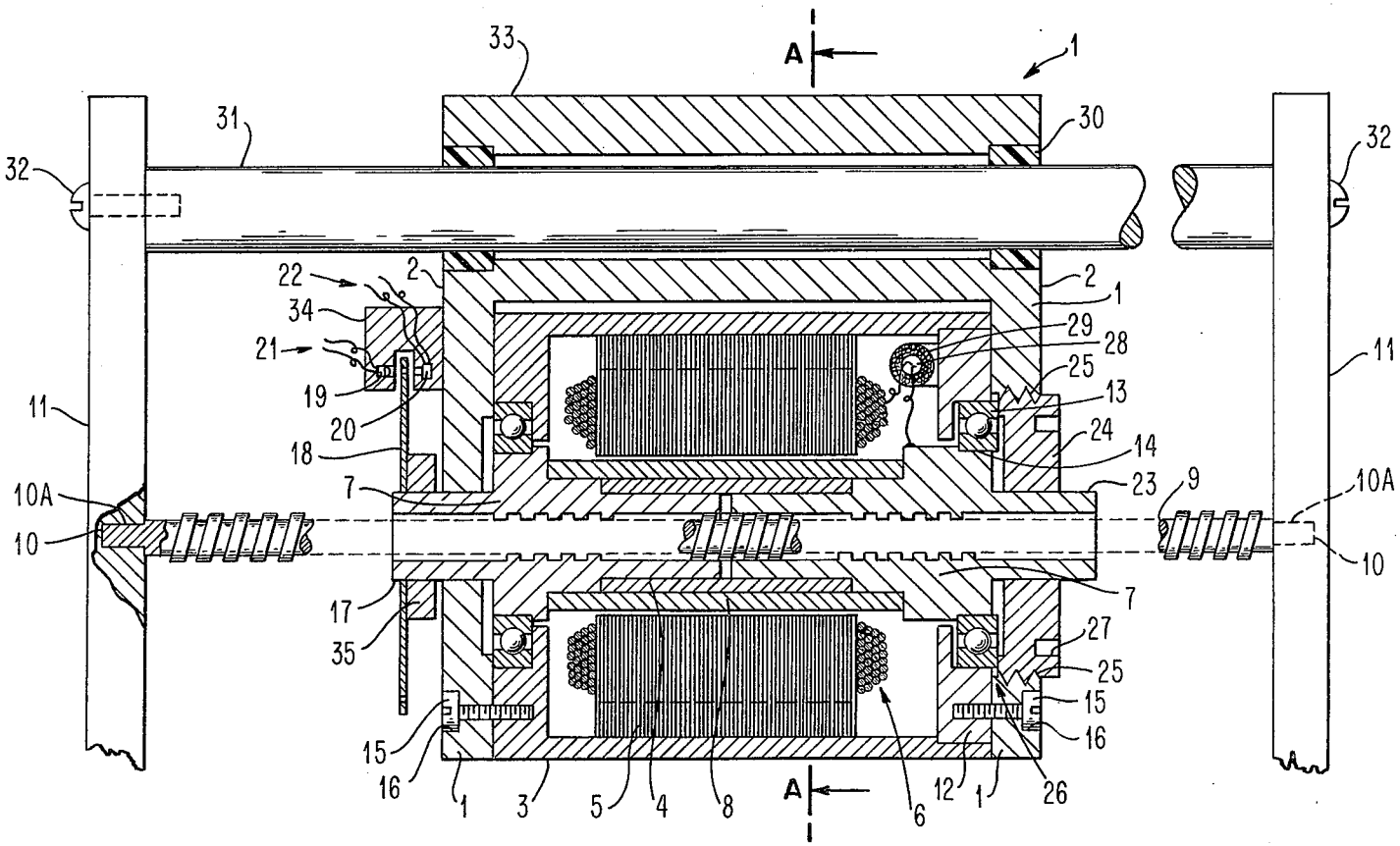
FIG. 1 is a horizontal, partially cross-sectional view taken through the assembly of motor, nut and lead screw apparatus.

With reference to FIG. 1, a preferred embodiment of the invention is constructed by mounting an overall carrier frame 1 having integral or separately bolted on end walls 2 and a motor housing 3 contained within the end walls 2 as shown. Within the motor housing 3, a rotor 4, comprising field laminates 5, and field coils 6 is shown. The motor is of the sequenced pulse rotary stepping motor type so that accurate control over the degree of rotation is produced when the windings are properly pulsed. The usual induction types of drive motor can also be used for continuous run applications.

Rotor 4 has been bored out axially along its center line to accept the press fit shoulder sections of two nuts 7 which are locked together with each other and with rotor 4 by means of splines 8. Nuts 7 are preferably threaded with an appropriate thread such as an acme, square thread, V-thread, etc, which threads are engaged with the threads on lead screw 9.

Leading screw 9 is rigidly mounted between machine end walls 11 by means of squared hole 10 to accept a squared-off surface 10A of each end of the lead screw 9.

End bells 12 of the motor hold ball bearings 13 which engage shoulders 14 formed on nuts 7 as illustrated. The end bell 12 may be bolted or otherwise affixed to the end walls 2 of the carrier 1 by means of screws 15 which may be recessed in recesses 16 in the end walls 2 as shown.

One of the nuts 7 is provided with a shoulder 17 which extends through its adjacent end wall 2 and serves as a mounting point for emitter disk 18. Emitter disk 18 is made of a relatively thin sheet of optically opaque material such as metal or plastic and has in it a series of radially spaced holes or grooves for intermittently interrupting a light beam coming from, for example, light emitting diode 19 to interrupt the beam of light impinging on phototransistor 20. Leads 21 and 22 supply electrical current and signals, respectively, from the light emitting diode 19 and the sensing transistor 20.

Precise output signals indicating the degrees of rotation experienced by the rotor, and consequently by nut 7 and emitter disk 18 which is affixed to shoulder 17 by a collar 35, may thus be obtained. Knowing the degrees of angular rotation experienced by the emitter disk, it is easy to compute the linear displacement which the overall carrier 1, together with the motor and nuts 7, will experience. An accurate computation of displacement will be produced provided that the pitch of lead screw 9 is accurately known.

The emitter disk 18 may be provided with a series of spaced grooves which intermittently break the light beam from the light emitting diode 19 passing to transistor 20 so that a pulsating signal is produced on the output leads 22. By counting the periodic variations in the output signal on leads 22, for example, a precise indication of the amount of linear motion which may be expected can be computed. Such devices are well known in the art and will not be discussed further.

At the opposite end of the motor a shoulder 23 is formed on nut 7 which slidingly engages the inner surface of an aperture in adjusting nut 24. Adjusting nut 24 is provided with threads 25 that mater with corresponding threads in the end wall 2 of carrier 1. A shoulder 26 is formed on nut 24 to bear against the ball bearing 13 so that the pressure and/or small axial displacements known as backlash in the bearing assembly may be adjusted and taken up. Nut 24 is provided with holes or recesses 27 into which a suitable spanner wrench or other tool may be inserted for adjusting the assembly.

Electrical supply leads 28 pass through the carrier 1 and the housing 3 via by an aperture (not shown) and an insulator bushing 29 to connect to the field coils 6 as illustrated. The leads 28 would exit from carrier 1 and trail along behind the assembly as it traverses its path from one end of lead screw 9 to the other and back. The same is true of the leads 21 and 22 providing electrical current and electrical signals, respectively, as detailed previously.

Figure 2:
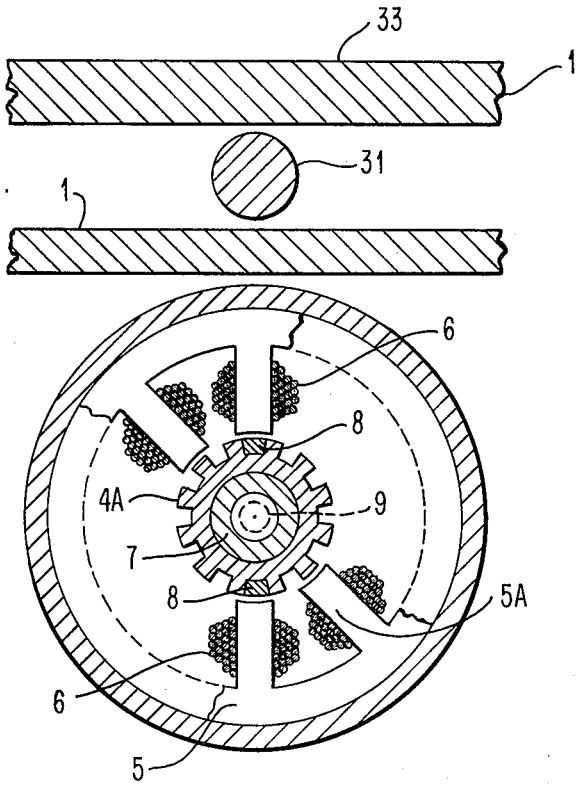
FIG. 2 is a sectional view taken along lines A-A in the apparatus of FIG. 1.

If the motor is energized by applying current through leads 28, the rotor 4 will experience a force generated between the rotor poles 4A and field poles 5A illustrated to better advantage in FIG. 2, and a small angular rotation dependent upon the number of rotor poles and field poles 4A and 5A, respectively, will be produced in the rotor 4. Provided that a resisting torque is applied to the case 3, the nuts 7 which are engaged with rotor 4 will be caused to turn. The resisting torque is provided by the guide bar 31 which is fitted with linear slide bearings 30 where it passes through the housing of the carrier 1. The guide bar 31 is rigidly affixed to frame 11 at each end by means, such as suitable screws 32, as illustrated.

The top surface 33 of carrier 1 may be utilized to mount any suitable print element or printing indicia device, such as a wire matrix head, as is well known in the art and the nature of such a device, not being important to the present invention, will be left without further detail.

So that an accurate indicia of the angular displacement occurring between emitter disk 18 and the carrier 1 may by obtained, a rigid mounting block 34 is affixed to end wall 2 as shown to hold the light emitting diode 19 and the photo sensing diode 20 in a fixed alignment. This sensor and emitter module 34 is a commercially available product and will not be described in greater detail.

In FIGS. 1 and 2, the nuts 7 are bored out to clear the threads on lead screw 9 through the portion where the press fit shoulders and the protruding shoulders are formed so that no interference exists and to reduce the frictional wear that would result because of numerous threads. However, the entire hollow bore of each of nuts 7 could be threaded to engage the threads on lead screw 9 if desired.

In FIG. 2, a view along line A—A taken through the apparatus in FIG. 1 is indicated. In the view in FIG. 2, the splines 8 which connect the individual nuts 7 with rotor 4 via means of milled or machined grooves in each of the nuts and between the poles 4A of rotor 4 are shown. The splines 8 prevent relative angular displacement between the nuts and rotor 4 so that they operate as one unit. The lead screw 9 which threadedly engages the nuts 7 is shown passing through the central bore in the rotor 4. It may be seen that the motor, the rotor 4, nut 7 and lead screw 9 are all concentrically arranged with one another into a compact and physically rugged structure. The field coils 6 and the field laminates 5 may also be seen in FIG. 2, and it will be understood that the number of field coils required is a matter of choice which depends upon the step size increment desired in the stepper motor assembly. The number of laminates 5 which are required is known to depend on the desired frequency response of the motor but these details are well known to those in the skill of stepper motor design and will not be described further here.

The assembly is manufacture by providing the nuts 7 and rotor 4 and assembling them on the lead screw 9 as shown after which the nuts 7 are pressed into the bore in rotor 4 from either end. Nuts 7 are then rotated relative to one another to obtain free rotation of the assembly of rotor 4 and nuts 7 together as one unit with a minimum amount of backlash. Then the shoulders in nuts 7 are milled or slotted in line with the rotor slot in rotor 4 and non-magnetic splines 8 are pressed into the slots to fix nuts 7 in an unvarying relationship to each other and to rotor 4. Then the entire assembly is inserted into the motor housing 3 as shown in FIG. 1 and adjustment nut 24 is adjusted for minimum end play in the assembly.

In operation, a series of electrical pulses is applied on the leads 28 to intermittently energize the motor. This will cause a stepwise angular rotation of rotor 4 and a smooth but stepwise linear motion of the overall assembly due to the engagement of nut 7 with lead screw 9. The nut 7 following along lead screw 9 will exert a force on the bearings 13 that will cause the housing 3 to move left or right, depending on the direction of rotation of the motor, and carry with it the carrier 1. Lead screw 9 is fixedly anchored at both ends in a manner that prevents rotation of the screw as shown. It may be seen that several advantages are inherent in the design and assembly which result as follows:

ADVANTAGES

Comparing the present design to a magnetic linear stepper motor, it may be seen that the present design presents a sealed magnetic unit in which all of the magnetic flux generated is contained, or may be contained, by suitable shielding in using a magnetic housing 3 within the unit instead of allowing stray magnetic flux fields to be introduced into the area immediately surrounding the mechanism as is the case with a linear stepper motor. It may also be seen that the only close tolerances required in the assembly of FIGS. 1 and 2 are those in the screw machine parts which are easily held to acceptable limits and do not require precise machining of flat or square surfaces. It may also be seen that conventional emitter or displacement transducer technology may be employed and that there are fewer transducers and trailing wires than with a linear stepper motor. Clearly, the linear motion of the assembly is a function of rotor rotation and the angle of lead or degree of lead in screw 9. It is, therefore, mechanically locked in place without the intervening air gap present in linear stepper motors. As a consequent result, the housing 3 and carrier 1 are not freewheeling if power to the stepper motor is interrupted, especially in the case where a permanent magnet motor is utilized.

By utilizing an emitter disk 18 with many slots, a number of pulses per printed character distance, measured linearly along the path of travel of carrier 1, can be produced for greater flexibility in adapting the electronics and for finer control in starting and stopping the mechanism. It should also be noted that the magnetic path of the rotary stepper motor is a much more efficient one and thereby requires a good less electrical power than a linear stepper motor.

The advantages of the present design as contrasted with a conventional driven screw and follower are also clear. Firstly, this design is more compact in that there is no outboard or exteriorly located motor or similar drive mechanism to take up additional space within the machine frame 11. Secondly, the moment of inertia of the lead screw 9 is eliminated in the system since the lead screw 9 does not move. Thirdly, there are fewer bearings, and, fourthly, there is no coupling between the motor and the lead screw 9 required for alignment or for the transmission of torque. This is a simplification in structure that considerably cuts cost and servicing difficulties. Fifthly, the lead screw 9 is at least four times as rigid in torsion, assuming equal length and diameters, at the weakest point than those in which the lead screw is driven. Also the lead screw 9 is twice as rigid in deflection due to the anchoring of the end in the frame 11 than in the driven lead screw type of design.

Having thus described the invention with reference to a preferred embodiment thereof and given a detailed example of its construction and mode of operation, it will be easily understood by those of skill in the art that a variety of mechanical modifications may be made without departing from the spirit and scope of the present design and invention, and it is therefore intended that the claims which follow not be limited with regard to the specific embodiment described.

What is claimed is:

1. Linear motion drive apparatus for a printer carriage or similar mechanism for a business machine, comprising:

a movably mounted carrier means for carrying an operative printing or similar marking element along a line of action within said machine;

a threaded screw means fixedly mounted in said machine parallel to, and at least as long as, said line of action to be traversed by said carrier means;

at least one threaded nut means laterally restrained and mounted for free rotation thereof in said carrier means and threadedly and concentrically engaging said screw means;

an electric motor having a rotor, a stator and a casing, said rotor, stator and casing being assembled concentrically with one another and with said nut means;

said rotor being affixed to said nut means to rotate said nut means;

said motor casing being affixed to said carrier means to prevent rotation of said motor casing;

said movably mounted carrier means being affixed to a slideable support means for permitting sliding motion of said carrier means in a direction parallel to said screw means; and means for applying electricity to said motor to cause it to rotate, thereby rotating said nut and producing linear motion thereof and of said motor and carrier means along said screw means.

* * * * *